United States Patent [19]

Klundt

[11] 4,111,139

[45] Sep. 5, 1978

[54] MULTINEEDLE GUARD CONSTRUCTION

[75] Inventor: Kurt Klundt, Hirschhorn, Germany

[73] Assignee: Pfaff Industriemaschinen GmbH, Germany

[21] Appl. No.: 764,813

[22] Filed: Feb. 2, 1977

[30] Foreign Application Priority Data

Feb. 28, 1976 [DE] Fed. Rep. of Germany ..... 76.06004[U]

[51] Int. Cl.[2] ..... D05B 55/02

[52] U.S. Cl. ..... 112/226

[58] Field of Search ..... 112/226, 163, 164, 165, 112/167, 218 R

[56] References Cited

U.S. PATENT DOCUMENTS

| | | | |
|---|---|---|---|
| 418,049 | 12/1889 | Muther | 112/226 |
| 1,075,743 | 10/1913 | Woodward | 112/226 |
| 1,404,750 | 1/1922 | Fifield | 112/218 R |
| 2,792,798 | 5/1957 | Zink | 112/226 |
| 3,020,866 | 2/1962 | Fujita | 112/226 |
| 3,348,508 | 10/1967 | Eguchi et al. | 112/226 |
| 3,450,078 | 6/1969 | Armstead | 112/226 X |

*Primary Examiner*—George H. Krizmanich
*Attorney, Agent, or Firm*—McGlew and Tuttle

[57] ABSTRACT

A multineedle clamp for sewing machines, comprises a needle clamp body which has a plurality of spaced parallel needle receiving bores defined therein, with a web portion defined between each two adjacent bores. A pressing screw is threaded into the needle clamp body from one side and bears against a needle positioned in the adjacent needle receiving bore to bias it in a direction against the web. The needle receiving clamp body also includes a transverse bore extending into the body at substantially right angles to the pressing screw which carries a resilient pad member which is biased against the peripheries of two adjacent needles at the locations where the bores thereof are separated by the web and open into the laterally extending bore. The webs may be formed as resilient elements joined to the needle clamp body and the crossbore receiving the resilient member advantageously opens into a third bore which extends parallel to the two adjacent needle bores and which intersects their circumference such that an arcuate portion of each needle bore communicates with the passage containing the resilient member.

5 Claims, 5 Drawing Figures

MULTINEEDLE GUARD CONSTRUCTION

FIELD AND BACKGROUND OF THE INVENTION

This invention relates in general to the construction of sewing machines and, in particular, to a new and useful multineedle clamps having a plurality of bores, the number of which corresponds to the number of needles and which are provided side-by-side and parallel to each other between the lateral walls of the needle guard body and intended to receive a needle butt.

SUMMARY OF THE INVENTION

In needle clamps which are intended for receiving two or more needles to be clamped in position in the needle clamp by means of a single screw, provided the needles are not disposed directly adjacent each other, an additional clamping piece is required to press the needles, under the action of the screw, against the wall of the needle guard body. In general, because of the necessary support and guidance of such a clamping piece, the volume of the needle guard must be increased. In addition, the clamping piece cannot be made of lightweight metal so that, for both reasons, a certain minimum mass is unavoidable.

The purpose of the present invention is to provide a simple design of a multineedle clamp which requires minimal space and is lightweight. To this end, the invention is directed to a multineedle clamp in which all of the needles can be clamped in position by a single screw, without any additional component parts.

In accordance with the invention, every two receiving bores adjacent each other are limited against each other by a laterally movable separating web, one of the needles, the first needle, which is in clamped position, bears against one of the lateral walls of the needle clamp body. A pressing screw engaged in the other lateral wall of the needle guard body presses the other outer needle in the direction of the first needle.

Advantageously, the separating web is resiliently joined to the needle clamp body. If each separating web forms an integral portion of the needle clamp body and is joined thereto so as to permit an elastic deformation of the web of an amount sufficient for clamping the needles, a particularly rugged needle clamp, which is simple to manufacture is obtained. The elastic deformation is facilitated if the junction of each separating web with the needle clamp body is provided on only one end.

An unintentional displacement or slipping out of newly inserted needles prior to their being clamped in place is prevented by providing a securing element which is seated transversely to the receiving bores for the needle butts, partly projects into the receiving bores, and bears resiliently against the needle butts therein.

Accordingly, it is an object of the invention to provide a multineedle guard construction for sewing machines, comprising a needle clamp body which has a plurality of spaced parallel receiving bores defined therein for accommodating individual needle bars and which is constructed with a web portion between adjacent bores and which includes a pressing screw which is threaded into the needle clamp body and bears against the side of one of the needles to urge it in a direction against the web portion and the adjacent needle.

A further object of the invention is to provide a multineedle guard construction for sewing machines which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
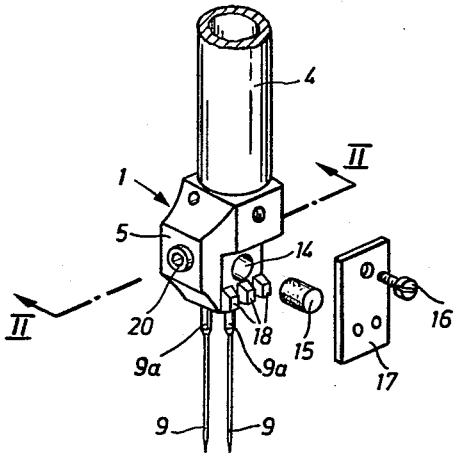
FIG. 1 is an exploded perspective view of a portion of a needle guard body constructed in accordance with the invention.
Figure 2:
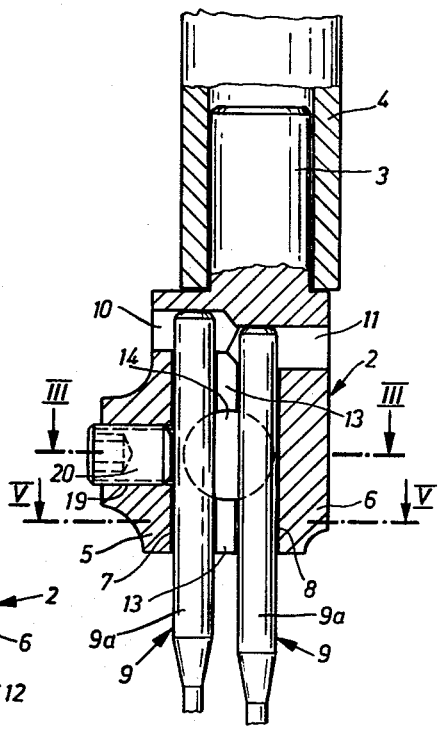
FIG. 2 is a partial sectional view taken along the line II—II of FIG. 1.
Figure 5:
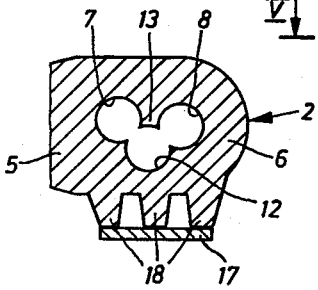
FIG. 5 is a sectional view taken along the line V—V of FIG. 2.
Figure 4:
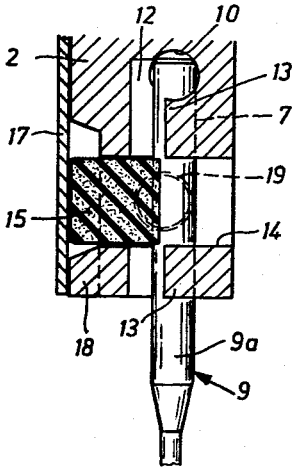
FIG. 4 is a sectional view taken along the line IV—IV of FIG. 3.
Figure 3:
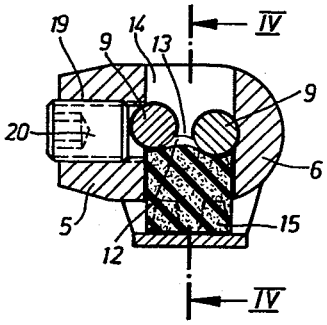
FIG. 3 is a sectional view taken along the line III—III of FIG. 2.

Referring to the drawing in particular, the invention embodied therein, comprises a needle clamp 1, which is adapted to be secured to a needle bar 4 of a sewing machine (not shown).

In accordance with the invention, needle clamp 1 comprises a needle clamp body 2 formed with an upwardly extending headpin portion 3 which is engaged within a hollow needle bar 4 and is clamped therein. Body 2 includes lateral walls 5 and 6 and, between these lateral walls, a plurality of spaced apart needle receiving bores, in this case, two needle receiving bores 7 and 8, are provided, which extend parallel to the longitudinal axis of needle bar 4 and which are sized to receive butt portions 9*a* of respective needles 9. Crossbores 10 and 11 are provided in respective side walls 5 and 6 which intersect the upper portions of the needle receiving bores 7 and 8 and they define upper wall portions or surfaces which provide stops for needles 9.

In accordance with a feature of the invention, a connecting bore 12 is defined within the needle clamp body which intersects a portion of the periphery of each of the bores 7 and 8 and is located symmetrically therebetween on one side thereof. The construction is such that a web portion 13 is formed between the adjacent bores 7 and 8, and this web portion may be integrally formed with the body, preferably of a material which has some resilience, or it may be formed as a separate part providing a resilient element between needles 9 positioned in the respective bores.

The clamp needle body 2 is also provided with a lateral or crossbore 14 which extends transversely to the bores 7, 8 and 12 and is intended as a weight reduction for receiving a resilient securing element 15 which may be made of a rubber or other resilient material and which is disposed in the bore under the pressure of a plate 17 fastened to the needle guard body 2 by means of screws 16. The pressure of securing element 15 applies against the needles 9. Plate 17 also covers thread passageways which are formed at the needle clamp body between spaced projections 18, 18. The bore 14 formed into a side of the clamp body 2 so as to extend through portions of the bores 7 and 8 and the material between the bores so as to leave a resilient web portion 13 therebetween. The diameter of the bore 14 is larger than the sum of the two radii of the two receiving bores 7 and 8 and the thickness of the web 13 which extends therebetween. Because the bores 7 and 8 are made rather close together the web 13 which is formed therebetween is elastically deformabke.

A threaded hole 19 is provided for a pressing screw 20 in a side wall 5. Screw 20 is threaded into the bore and abuts an adjacent needle 9. This needle 9 in turn is pressed through the elastically deformable web 13 against the other needle 9. The last needle in a row bears against a lateral wall 6 of needle clamp body 2. In view of the tolerances which are usual in the sewing machine construction between the diameter of the butts of needle 9 and the diameters of the two receiving bores 7 and 8, the deformation of web 13 occurs upon clamping of the needles.

The securing element 15 projects resiliently into receiving bores 7 and 8 and prevents needles 9 from dropping out or being displaced prior to being clamped in position by the operator who tightens pressing screw 20.

While a specific embodiment of the invention has been shown and described in detail to illustrate the application of the principles of the invention, it will be understood that the invention may be embodied otherwise without departing from such principles.

What is claimed is:

1. A needle clamp, comprising a needle clamp body having a plurality of spaced parallel needles receiving bores defined therein, a needle having a shank portion positioned in each of said bores, said clamp body having a web portion which is laterally displaced and which is defined between adjacent needle receiving bores, a pressing screw threaded into said needle clamp body and bearing against the side of one of said needles which is positioned in the respective bores on a side thereof opposite to said web portion and substantially perpendicular to the axis of the needle receiving bores so as to urge said needle in a direction against said web portion and next adjacent needle a pressing member bore extending inwardly from a side of said needle clamp body at right angles to the threaded securing screw bore and into a portion of each of the needle receiving bores to the end of said web portion between said needle receiving bores, a resilient member disposed in said connecting bore bearing against the needles therein, a plate member disposed on the exterior of said needle clamp body closing the resilient member receiving bore and holding the resilient member in a position to bear against the needles to hold them in position until they are secured by said securing screw.

2. A needle clamp, according to claim 1, including a crossbore connected from each side wall into an associated needle receiving bore adjacent the upper ends thereof and having surfaces defining stops for the tops of the needles positioned therein.

3. A clamp, according to claim 2, including a plurality of projections on a side of said needle clamp body in the vicinity of the resilient member receiving bore and defining thread passages between adjacent projections.

4. A needle clamp, comprising a needle clamp body, having a plurality of spaced parallel needle receiving bores defined therein, a needle having a shank portion position in each of said bores, said clamp body having a resiliently deformable web portion defined adjacent said needle receiving bores, a pressing screw threaded into said needle clamp body and bearing against the side of one of said needles which is positioned in the respective bore toward said needle at a direction against said web portion and next adjacent needle, a lateral bore extending through said clamp body having a diameter greater than a needle receiving bore and the web therebetween and which cuts into each adjacent bore and defines the inner end of a web portion, and a resilient securing element positioned in the lateral bore bearing against said needles.

5. A needle clamp, comprising a needle clamp body, a pair of spaced parallel needle receiving bores defined through said clamp body, a needle in each of the bores, a connecting bore defined through said clamp body located centrally between adjacent needle receiving bores on one side of the sides thereof and extending into a portion of the periphery of said needle receiving bores and into the material between the bores so as to leave a resilient web portion of said guard body between the needle receiving bores, said needle clamp body having a threaded securing screw bore extending inwardly from a side wall into an adjacent needle receiving bore at a side thereof opposite to said resilient web portion, a threaded pressing screw threaded into the threaded securing screw bore and bearing against the needles positioned in the adjacent bores.

* * * * *